United States Patent [19]

Gattu

[11] 4,337,868

[45] Jul. 6, 1982

[54] TELESCOPIC CRANE BOOM HAVING ROTATABLE EXTEND/RETRACT SCREWS

[75] Inventor: Narahari Gattu, Cedar Rapids, Iowa

[73] Assignee: Harnischfeger Corporation, West Milwaukee, Wis.

[21] Appl. No.: 122,506

[22] Filed: Feb. 19, 1980

[51] Int. Cl.[3] ..... B66C 23/06

[52] U.S. Cl. ..... 212/267; 212/264; 52/111; 52/632; 74/89.15

[58] Field of Search ..... 212/267, 264, 230, 231, 212/159; 52/632, 111, 121, 110, 118; 74/89.15, 665 A

[56] References Cited

U.S. PATENT DOCUMENTS

| | | | |
|---|---|---|---|
| 1,669,479 | 5/1928 | Lowy | 52/632 |
| 4,094,230 | 6/1978 | Wright et al. | 212/264 |
| 4,125,974 | 11/1978 | Kay et al. | 212/164 |

FOREIGN PATENT DOCUMENTS

| | | | |
|---|---|---|---|
| 289534 | 1/1916 | Fed. Rep. of Germany | 52/111 |
| 295440 | 11/1916 | Fed. Rep. of Germany | 52/111 |

*Primary Examiner*—Edward R. Kazenske
*Assistant Examiner*—L. E. Williams
*Attorney, Agent, or Firm*—James E. Nilles

[57] ABSTRACT

A multisection hollow telescopic boom comprises a base section, an intermediate section and a fly section. A first elongated rotatable screw located within the boom has its base end rotatably mounted on the base end of the base section and engages a first nut which is rigidly mounted on the base end of the intermediate section. A second elongated rotatable screw located within the boom has its base end rotatably mounted on and connected to the base end of the intermediate section and engages a second nut which is rigidly mounted on the base end of the fly section. A screw drive rotates the screws to effect axial telescopic movement of the boom sections. In one embodiment the screw drive comprises a single motor for driving the first screw, a first sprocket rotatably driven by the first screw, a second sprocket for rotatably driving the second screw, and a drive chain connected between the sprockets. In another embodiment, the screw drive comprises a single motor for driving a first screw which extends into a hollow second screw, and axially slideably coupling connected between the two screws enables the first screw to rotate the second screw. In still another embodiment the screw drive comprises an individual motor for driving each screw. Screw supports are provided.

9 Claims, 24 Drawing Figures

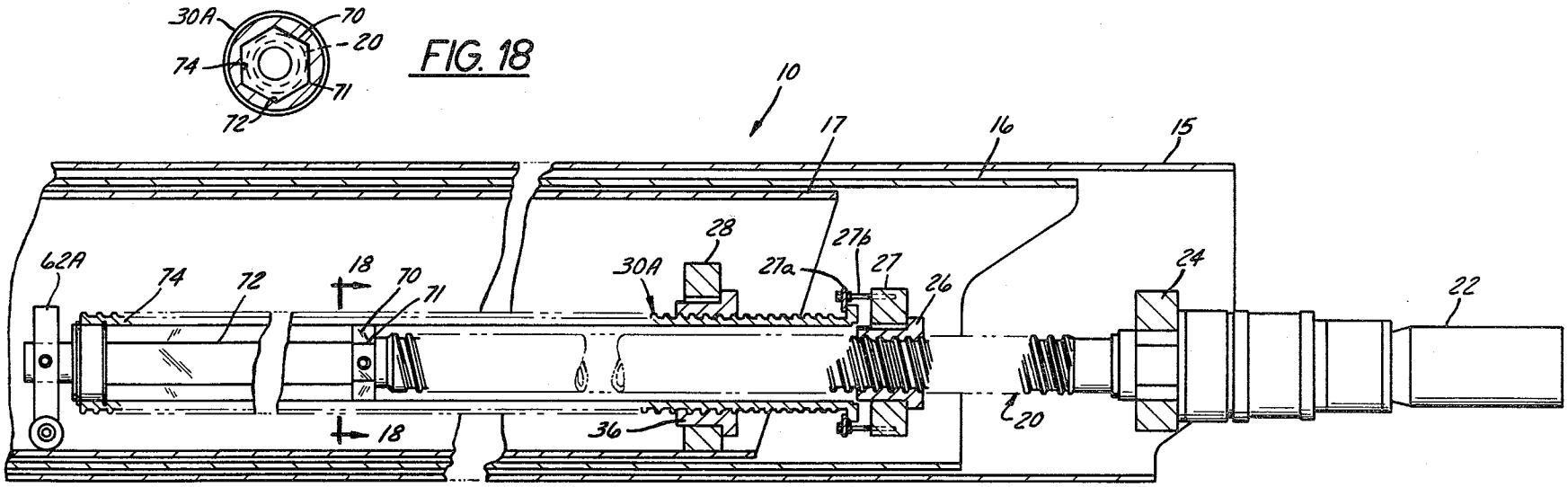
FIG. 16
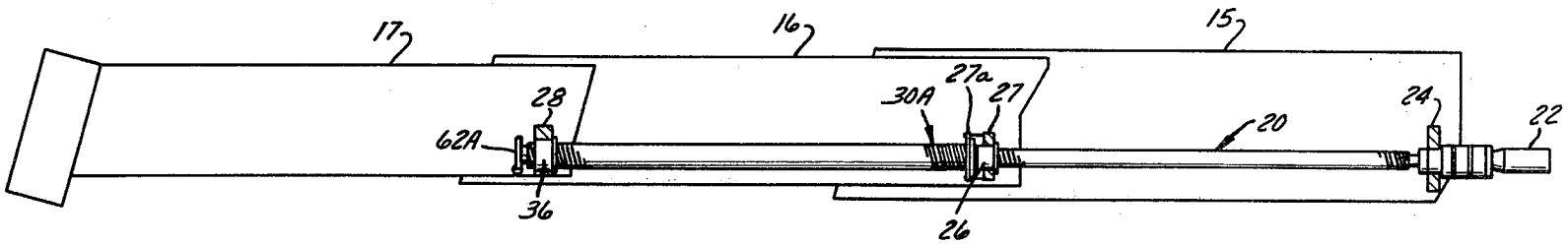
FIG. 17
FIG. 18

TELESCOPIC CRANE BOOM HAVING ROTATABLE EXTEND/RETRACT SCREWS

BACKGROUND OF THE INVENTION

1. Field of Use

This invention relates generally to multisection telescopic crane booms having rotatable screws for extending and retracting the boom sections thereof and, in particular, to driving and support means for such screws.

2. Description of the Prior Art

In conventional multisection telescopic crane booms, such as are used on mobile cranes or the like, it is well known to employ extendable/retractable elongated hydraulic cylinder units interconnected between relatively movable boom sections to extend and retract the boom. As telescopic booms increase in size and weight and in the number of movable sections, the size, weight, number and complexity of hydraulic cylinders increase accordingly. It is desirable therefore to provide other improved means to operate relatively large telescopic booms.

U.S. Pat. No. 3,326,391 discloses a manually operated portable load handling swinging crane of relatively small size for handling moderate loads and which comprises two telescopically movable hollow parts including an extension part which is telescopically extendable and retractable relative to a main part by means of a manually rotatable single elongated screw which has its base end rotatably supported on the base end of the main part and engages a threaded insert fixed to the base of the extension part.

U.S. Pat. No. 4,062,156 discloses a four-section vertically disposed extendable small "rod", such as a car radio antenna having three movable sections which telescope within a housing and wherein a motor driven, rotatable single elongated screw which has its base end rotatably supported on the base end of a housing engages a threaded member on the base end of each of the three movable sections.

U.S. Pat. No. 3,296,757 shows a multi-section telescopic vertical mast wherein an exteriorly-located manually or motor-driven rotatable screw connected between a lowermost housing section and a topmost section effects telescopic movement of all movable sections, as one section acts upon another to effect axial movement.

Norwegian Pat. No. 23666 (1913) shows arrangements similar to U.S. Pat. No. 3,296,757 and U.S. Pat. No. 4,062,156.

German Pat. Nos. 289,534 (1913) and 295,440 (1913) show multi-section vertically disposed telescopic masts wherein a plurality of manually operated screws, one driven by another, are employed to extend and retract movable mast sections but the screw arrangements are such that not all movable sections can telescope within the base section, as German Pat. No. 295,440 makes clear in FIG. 2.

U.S. Pat. Nos. 3,082,607; 1,342,828 and 1,286,807 show other telescopic mast arrangements.

U.S. Pat. Nos. 4,125,974; 4,098,172; and 4,094,230 show arrangements for supporting hydraulic cylinders in telescopic booms.

SUMMARY OF THE INVENTION

The present invention contemplates a multi-section telescopic boom having at least a hollow base section; a hollow intermediate section telescopable within the base section; a hollow fly section telescopable within the intermediate section, and a hollow manual section telescopable within the fly section. A first elongated rotatable screw is located within the boom and has its base end rotatably mounted on and connected to the base end of the base section. A first nut means is rigidly mounted on the base end of the intermediate section and is engaged by the first screw. A second elongated rotatable screw is located within the boom and has its base end rotatably mounted on and connected to the base end of the intermediate section. A second nut means is rigidly mounted on the base end of the fly section. Screw drive means are provided and are operable to rotate both screws simultaneously to effect axial telescopic movement of the axially movable boom sections, and the screw drive means comprise at least one motor located near the base end of the base section and connected to effect rotation of the first screw, and means connected to effect rotation of the second screw.

In accordance with one embodiment of the invention, the means to effect rotation of the second screw comprises rotation transmission means connected or coupled between the first screw and the second screw whereby rotation of the former effects rotation of the latter, such as a drive sprocket driven by a rotatable hollow housing which, in turn, is rotated by the first screw, a driven sprocket for driving the second screw, and a flexible chain connected between the sprockets.

In accordance with another embodiment, the means to effect rotation of the second screw includes interengageable means on said first and second screws, and particularly, an arrangement where the first screw extends into a hollow second screw, and wherein a projection on the first screw slideably engages an axially extending groove on the hollow interior of the second screw.

In accordance with still another embodiment, the means to effect rotation of the second screw is a second motor mounted near the base end of the intermediate section and connected to drive the second screw.

Support means are provided to support the elongated screws at their outermost ends on the boom.

Multi-section telescopic crane booms employing rotatable extend/retract screws and drive means therefor in accordance with the invention provide numerous important advantages over booms using hydraulic cylinders, such as significant weight and space reduction, faster actuation, and precise boom length measurement.

In addition, since the weight of the screws, drive motors and associated components is closer to the boom foot (i.e., farther away from the boom head) than that of conventional telescoping hydraulic cylinders used for boom extension, improved machine stability results. Also, positive synchronous boom section extension is obtained by arrangements wherein coupling of the screws is employed and this is not easily possible with hydraulic cylinders. Further weight saving can be achieved in arrangements wherein novel mid-supports especially adapted for use with screws are employed, as shown in our copending U.S. patent application Ser. No. 122,488, filed Feb. 19, 1980 and entitled Movable Support For Rotatable Extend/Retract Screw In Telescopic Crane Boom, our Docket #24A, and assigned to the same assignee as the present application, since similar mid-supports on hydraulic cylinders are very complex, as U.S. Pat. No. 3,836,011 shows.

Another advantage over the prior art is that the embodiments disclosed herein permit all movable boom sections to telescope within the base section, such arrangement being required in typical mobile cranes.

Other objects and advantages of the invention will hereinafter appear.

DESCRIPTION OF THE DRAWINGS

FIG. 16 is a side elevational view of a telescopic boom, shown retracted, and having screws and drive means therefor in accordance with a second embodiment of the invention;

FIG. 17 is a view similar to FIG. 16, but showing the boom extended;

FIG. 18 is a cross-sectional view taken on line 18—18 of FIG. 17.

DESCRIPTION OF PREFERRED EMBODIMENTS

General Arrangement

A first embodiment of the invention using a single screw drive motor and a sprocket and chain drive coupling between the two screws, is shown in FIGS. 1 through 15; a second embodiment employing a single screw drive motor and direct drive coupling between the two screws, one within the other, is shown in FIGS. 16 through 18; and a third embodiment using two separate screw drive motors and no drive coupling between the two screws is shown in FIGS. 19 through 23.

Figure 1:
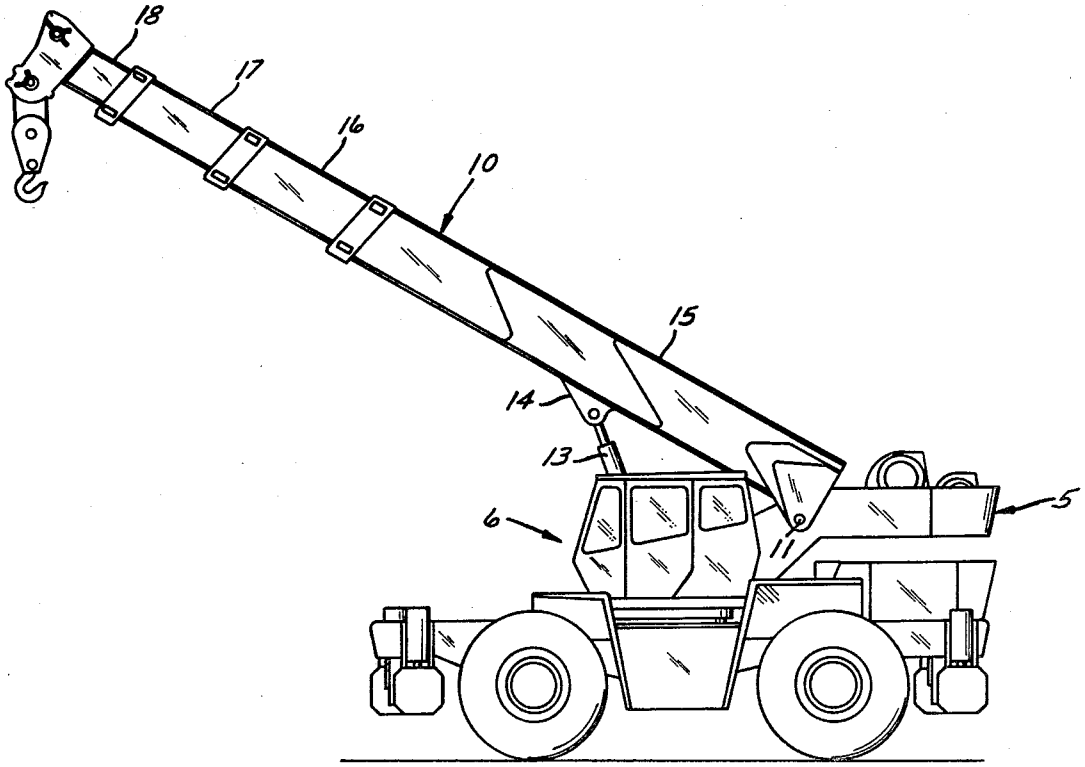
FIG. 1 is a side elevational view of a mobile crane having a multi-section telescopic boom of a type having rotatable extend/retract screws and drive means therefor in accordance with the invention.

Referring to FIG. 1, all embodiments are adapted for use, for example, in a telescopic crane boom 10 which is mounted on the rotatable upper section 5 of a mobile crane 6, as by means of a trunnion 11 at its base end and which is understood to be pivotable in a vertical plane about trunnion 11 between raised and lowered positions by means of a hydraulic lift cylinder 13 which is pivotably mounted to an attachment bracket 14 on the boom. Boom 10 comprises a hollow base section 15, a hollow intermediate section 16 slideably and telescopically receivable within base section 15, a hollow fly section 17 slideably and telescopically receivable within intermediate section 16, and a manual section 18 telescopically receivable within fly section 17. FIG. 1 shows boom 10 partially extended. For purposes of discussion herein, sections 15 and 16 are sometimes referred to as "outer" sections relative to "inner" sections 16 and 17, respectively.

All embodiments employ a first elongated rotatable screw 20 having a thread 25 which is located within boom 10 and has its base end rotatably mounted on and connected to screw drive means, hereinafter described on the base end of base section 15. A first nut means 26 is rigidly and non-rotatably mounted on the base end of intermediate section 16 by a support means 27 and is engaged by first screw 20. All embodiments also employ a second elongated rotatable screw 30 having a thread 35 which is located within the boom 10 and has its base end rotatably mounted on a bearing 32 which is connected to the base end of intermediate section 16 also by support means 27. A second nut means 36 is rigidly and non-rotatably mounted on the base end of fly section 17 by support means 28. Screw drive means are provided in all embodiments and are operable to rotate both screws simultaneously to effect axial telescopic movement of the axially movable boom sections. The screw drive means, hereinafter described, comprise at least one motor 22 on the base end of base section 15 and connected to effect rotation of the first screw 20. The screw drive means further comprise means connected to effect rotation of second screw 30. In operation, rotation of screws 20 and 30 relative to non-rotatable first nut 26 and second nut 36, respectively, causes axial sliding relative movement of "inner" sections 16, 17, respectively, relative to "outer" sections 15, 16, respectively, such movement being in the extend or retract direction depending on the selected direction of rotation of screws 20 and 30.

First Embodiment

Figure 2:
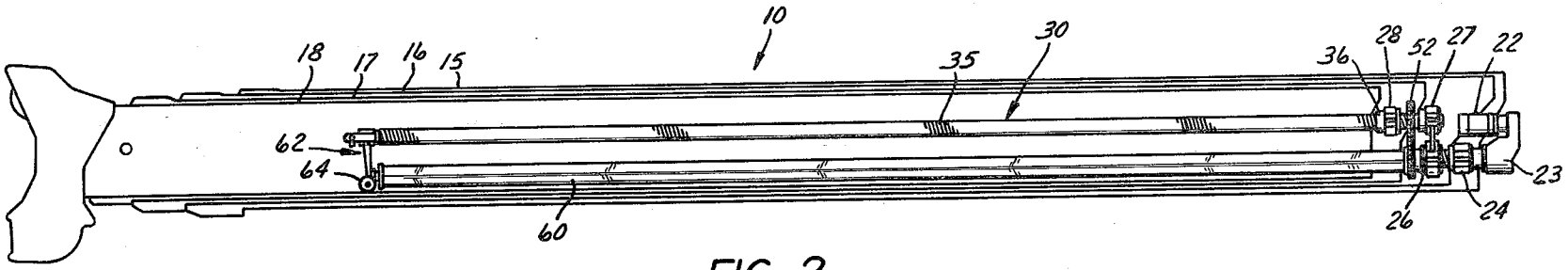
FIG. 2 is an enlarged, side elevational view of the boom of FIG. 1, shown retracted, and having screws and drive means therefor in accordance with a first embodiment of the invention.
Figure 3:
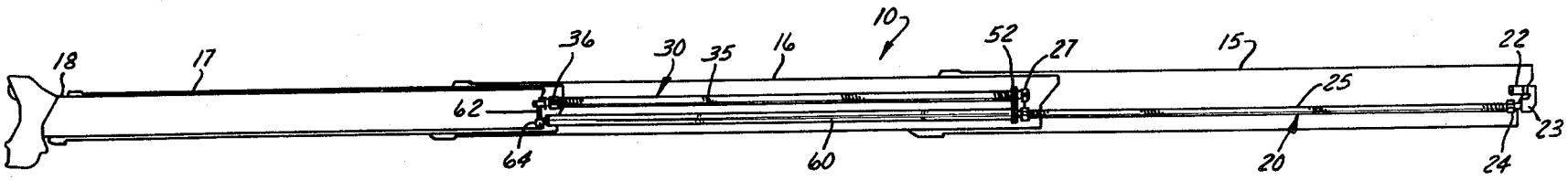
FIG. 3 is a side elevational view, in reduced scale, of the boom of FIG. 2, shown extended.
Figure 4:
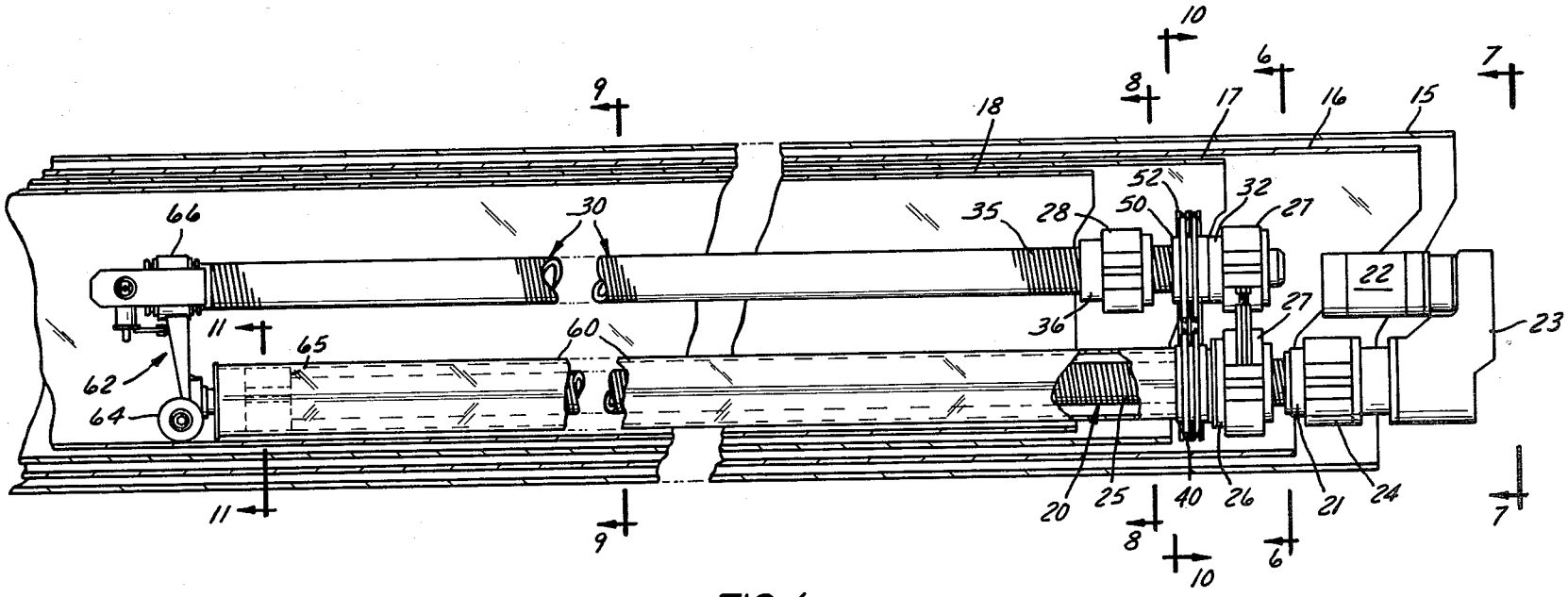
FIG. 4 is an enlarged view similar to FIG. 2.
Figure 5:
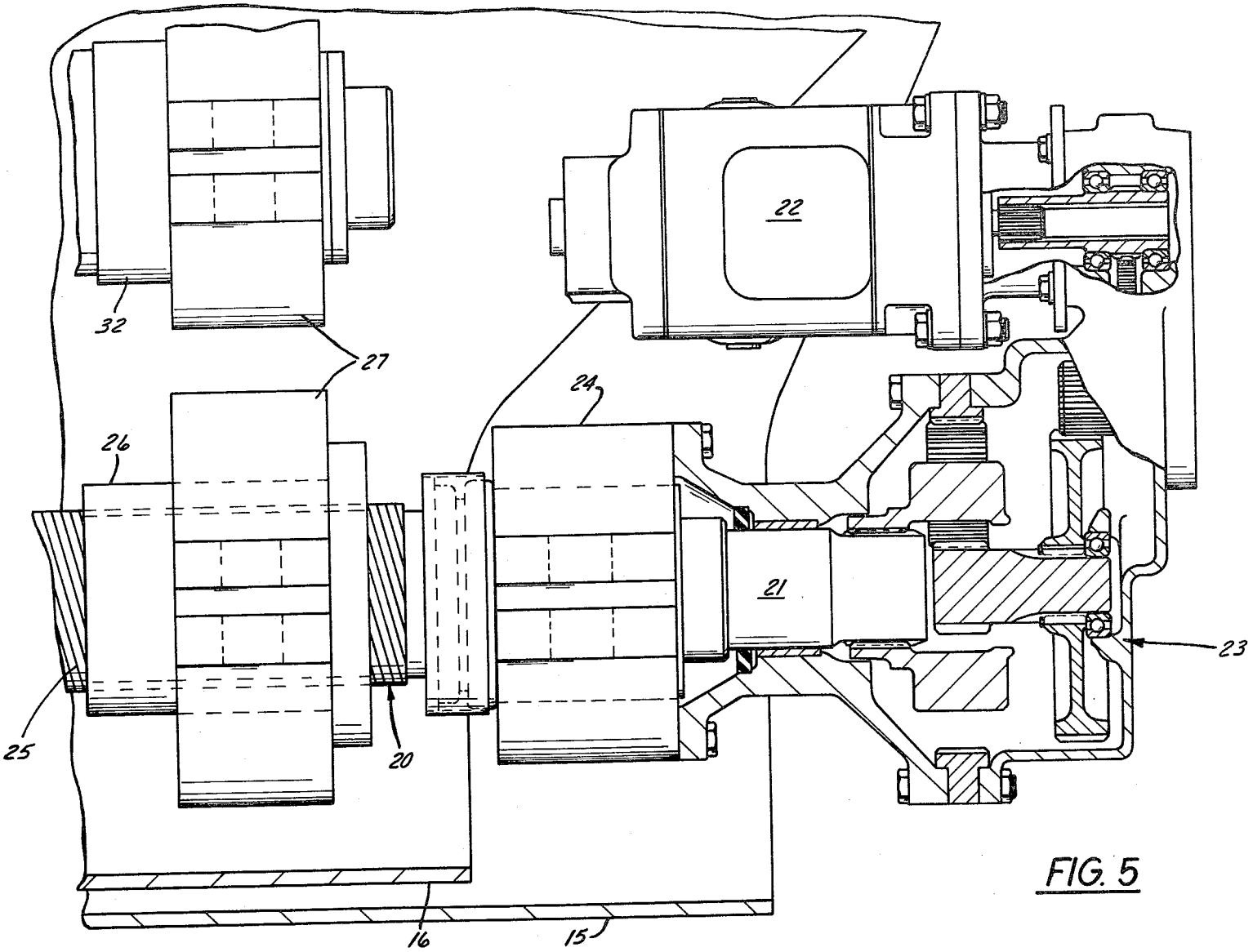
FIG. 5 is an enlarged, side elevational view, partly in cross-section, of certain components shown in FIG. 4.
Figure 5A:
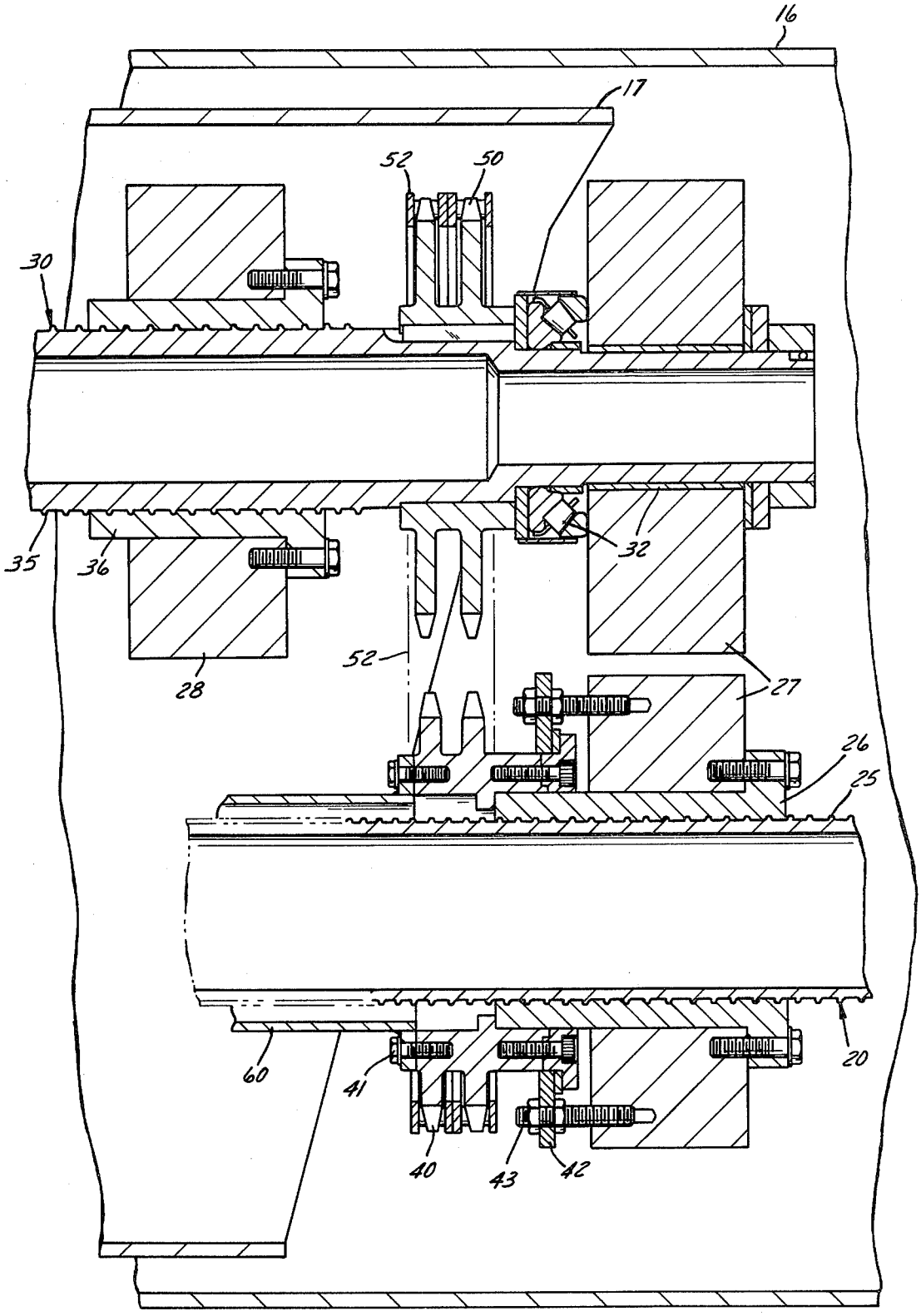
FIG. 5A is a cross-sectional view of components of FIG. 5.
Figure 8:
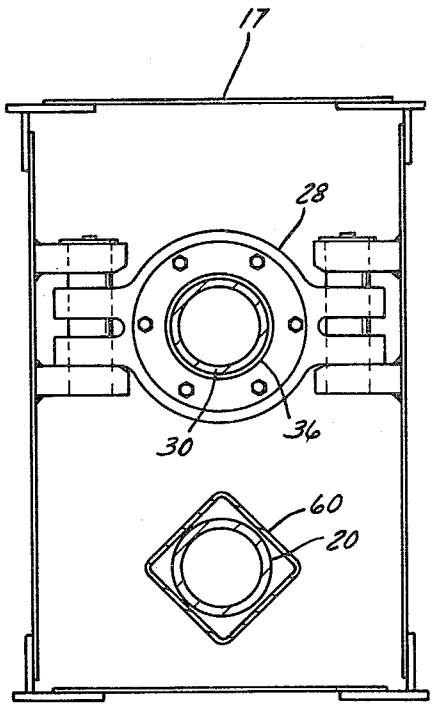
FIGS. 6 through 11 are enlarged, cross-sectional views taken at various stations on correspondingly numbered section lines in FIG. 4.
Figure 7:
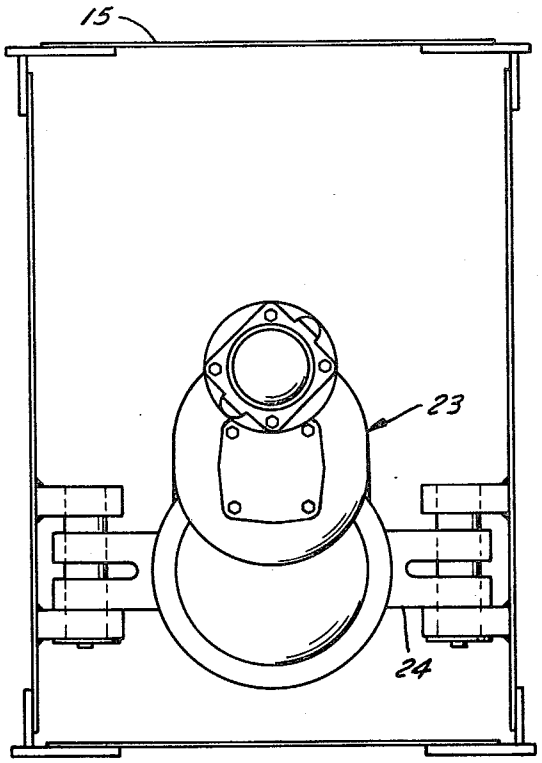
Figure 6:
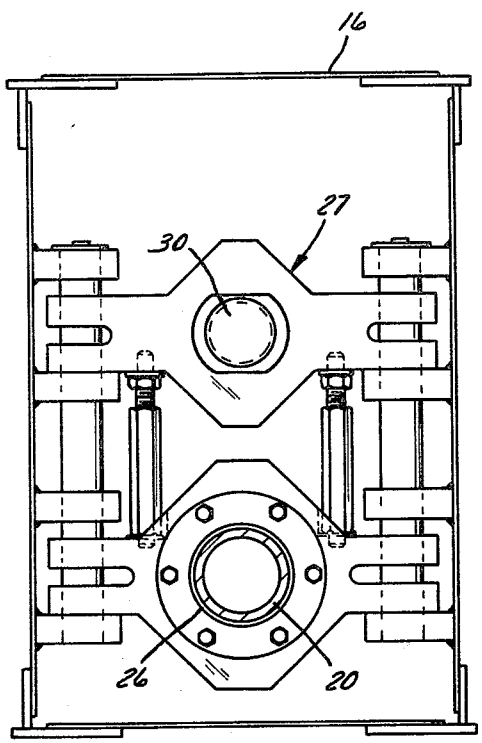
Figure 10:
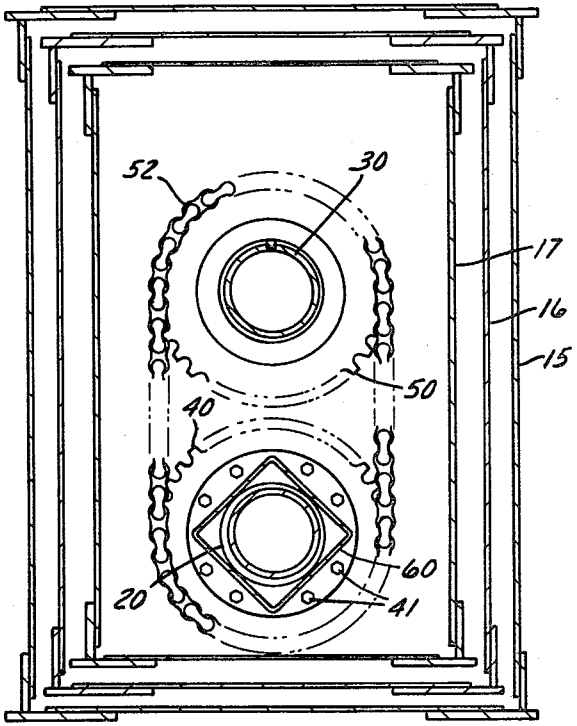
Figure 9:
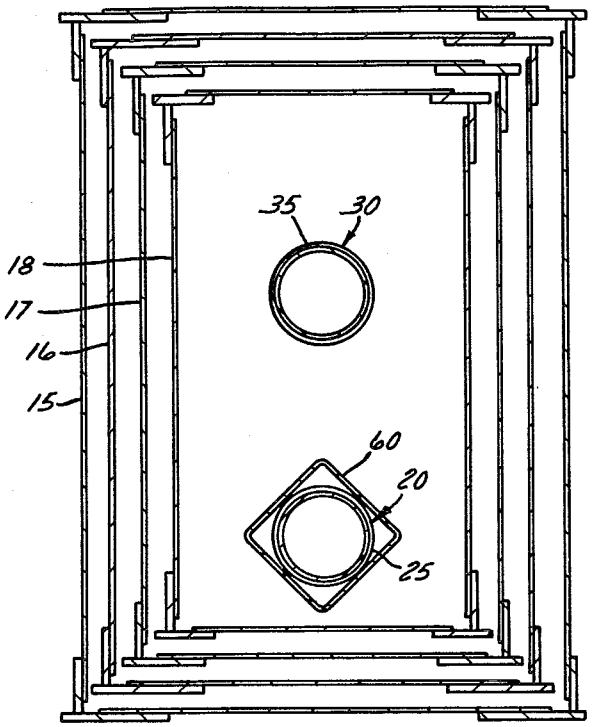
Figure 15:
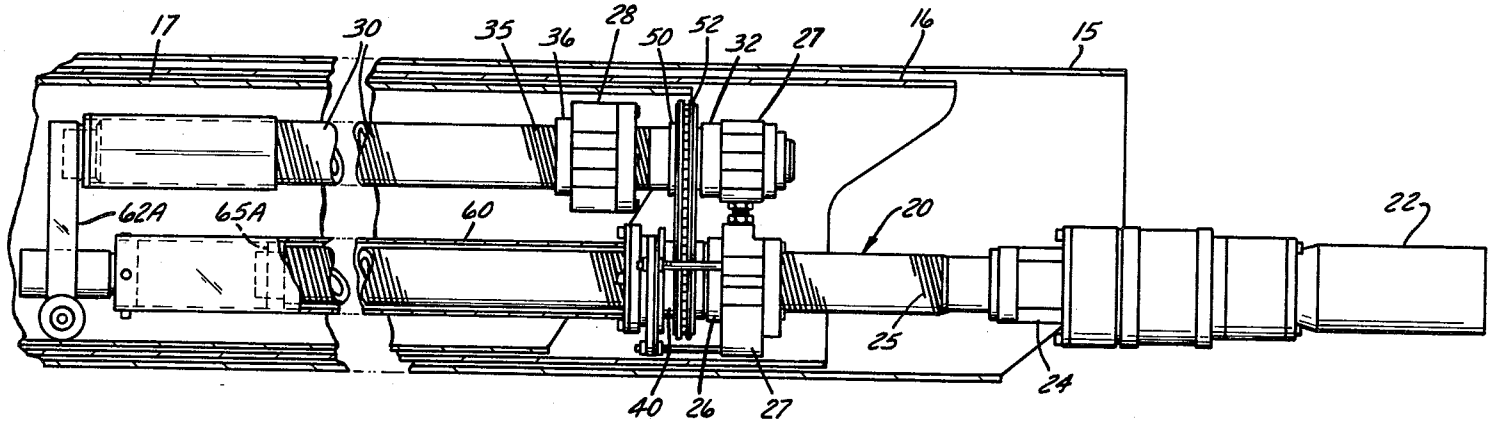
FIG. 15 is an enlarged side elevational view, partly in cross-section and with portions broken away, of a modification of the drive shown in FIG. 4.

Referring to FIGS. 2 and 3, which respectively show boom 10 fully retracted and extended, and to FIGS. 4, 5 and 5A, the screw drive means in the first embodiment comprises a hydraulic motor 22 which is supported on and drives a gear reduction unit 23. The latter, in turn, is mechanically supported on base section 15 by means of a support bracket 24 (see FIGS. 6, 7 and 8). Reduction unit 23 includes a rotatable drive shaft 21 which is connected to rotatably drive first screw 20. Rotation of first screw 20 relative to first nut 26 causes relative axial telescopic movement between boom sections 15 and 16. FIG. 15 shows an alternative arrangement wherein motor 22 is directly supported on base section 15 and directly connected to drive screw 20; the gear reduction unit being omitted.

The screw drive means further includes rotation transmission means connected between first screw 20 and second screw 30 whereby rotation of the former effects rotation of the latter. As FIGS. 2, 3, 4, 5A, 6, 7, 8, 13 and 14 show, such rotation transmission means includes a first rotatable drive sprocket or member 40 which is rigidly mounted by bolts 41 on the base end of a rotatable non-circular hollow tube 60 which is rotatably connected to a flange 42 which is rigidly secured by bolts 43 to lower support means 27 which retains non-rotatable nut 26 so as to be movable with boom section 16. The free end of screw 20 is provided with a non-circular drive member 44, FIGS. 4, 13 and 11, which is non-rotatably and slideably engaged with the interior of non-circular tube 60 so that rotation of screw 20 causes rotation of tube 60 and attached sprocket 40 as boom section 16 moved axially. The rotation transmission means further includes a second rotatable driven sprocket or member 50 which is supported on second screw 30 and rigidly connected thereto for rotation therewith. An endless flexible drive chain 52 is reeved around sprockets 40 and 50 and rotation of drive sprocket 40 effects rotation of driven sprocket 50 and second screw 30. Rotation of second screw 30 relative to second nut 36 causes relative axial telescopic movement between boom sections 16 and 17.

Figure 11:
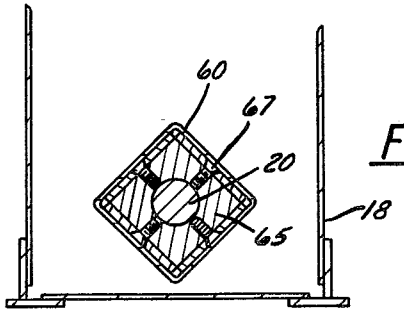
Figure 13:
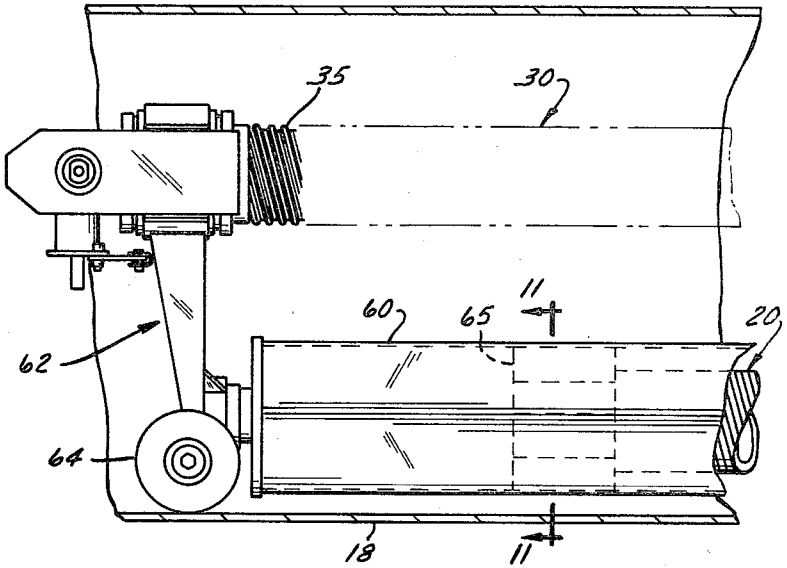
FIG. 13 is a side elevational view of the structure shown in FIG. 12.
Figure 14:
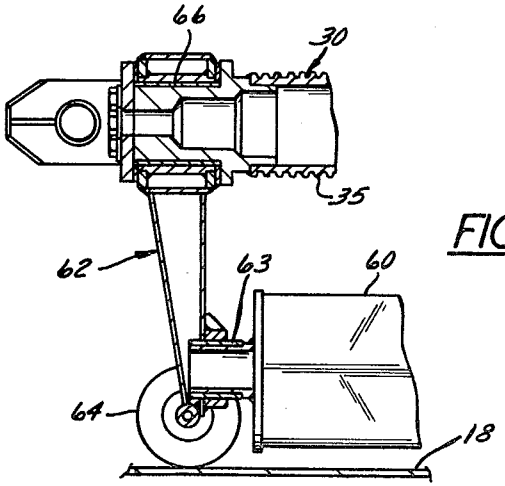
FIG. 14 is a cross-sectional view of the structure shown in FIG. 13.
Figure 12:
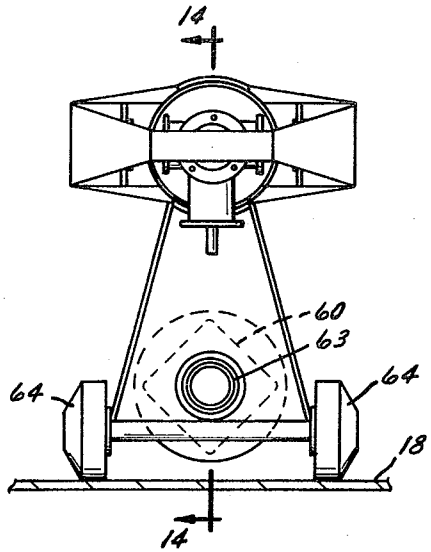
FIG. 12 is an enlarged end elevational view, partly in cross-section, of the screw support structure shown at the left side of FIG. 4.

As FIGS. 2, 3, 4, 13, 14 and 15 best show, support means are provided to physically and mechanically support the relatively long screws 20 and 30, since in certain configurations during operation of telescopic boom 10, as when fully retracted, the screws would be supported in cantilever fashion near their base ends (see FIGS. 2 and 4) and would tend to bend or deflect downwardly at their free unsupported ends under their own weight. Such support means include the non-rotatable hollow tubular drive member 60, hereinbefore described, which surrounds first screw 20 and has its base end rotatably supported relative to first nut 26. The other end of tubular member 60 is rotatably supported on a bearing 63 on a support carriage 62 and the free end of second screw 30 is rotatably supported on support carriage 62. Support carriage 62 is provided with a pair of wheels 64 which ride on the inside surface of the bottom wall of boom fly section 18. Screw 20 has a square drive block 65 secured to its end by adjusting screws 67 (FIG. 11). The end drive means of screw 20 is rotatably slideable within tubular member 60 to effect rotation of sprocket 40. Support carriage 62 includes an adjustable internal bearing 66, which receives and supports the relatively rotatable end of screw 30. As FIGS. 2 and 3 show, telescopic movement of boom section 17 effects corresponding movement along therewith of tubular member 60 and support carriage 62 and the carriage wheels 64 ride on fly section 18.

Second Embodiment

Referring to FIGS. 16 and 17, which respectively show boom 10 fully retracted and extended, and to FIG. 18, in the second embodiment, motor 22 of the screw drive means is directly supported on the base end of base section 15 and is directly connected to drive screw 20 which engages first nut 26 on the base end of boom section 16. Rotation of first screw 20 relative to first nut 26 causes relative axial telescopic movement between boom sections 15 and 16. Second screw 30A, which is tubular or hollow, has its base end rotatably engaged in and supported on the second nut 36 which is fixed on the base end of boom section 17.

The screw drive means in the second embodiment further includes rotation transmission means connected between first screw 20 and second screw 30A, whereby rotation of the former effects rotation of the latter. The large tubular screw 30A is retained by a thrust collar **27*a* fixed by bolts 27*b* on the stationary nut 26. Thus screw 30A is free to rotate. This rotation transmission means includes a first rotation transmission member or head 70 which is rigidly connected to the end of first screw 20 and rotatable therewith. Head 70 is of non-circular cross-sectional configuration (see FIG. 18), such as hexagonal, and its corners 71 serve, in effect, as projections which engage correspondingly shaped grooves or corners 72 in the mating non-circular cross-sectional interior wall 74 of hollow second screw 30A. Thus, rotation of first screw 20 causes corresponding rotation of second screw 30A. Rotation of second screw 30A relative to second nut 36 causes relative axial telescopic movement between boom sections 16 and 17 and, in addition, cause axial sliding movement of second screw 30A relative to first screw 20**.

Support means are provided for the screws 20 and 30A, and take the form of a support carriage 62A, similar to carriage 62 hereinbefore described, except that carriage 62A rotatably supports the end of second screw 30A and, in doing so, necessarily affords support for first screw 20 within screw 30A.

Third Embodiment

Figure 19:
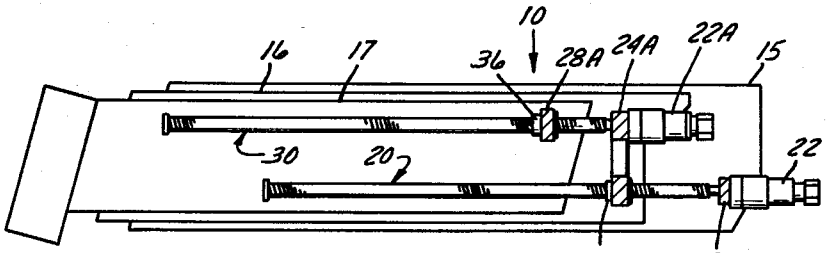
FIG. 19 is a side elevational view of a telescopic boom, shown retracted, and having screws and drive means therefor in accordance with a third embodiment of the invention.
Figure 20:
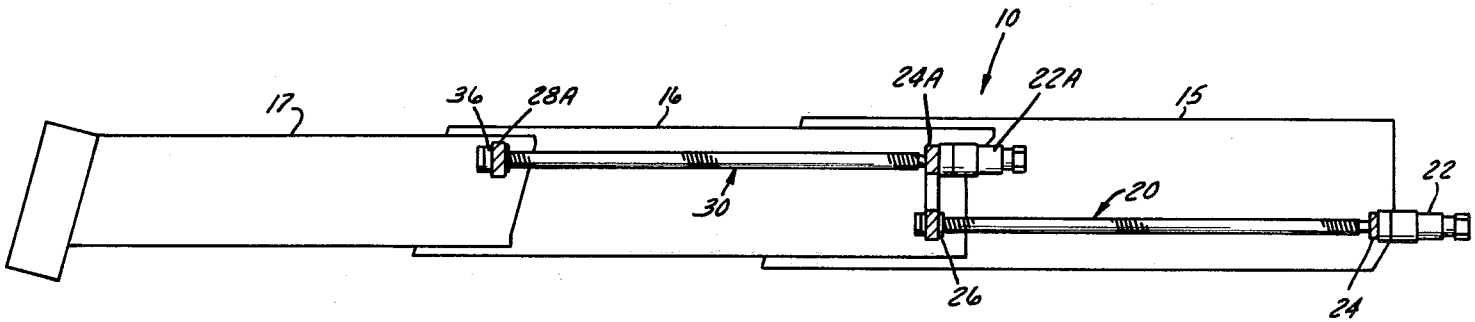
FIG. 20 is a view similar to FIG. 19, but showing the boom extended.
Figure 21:
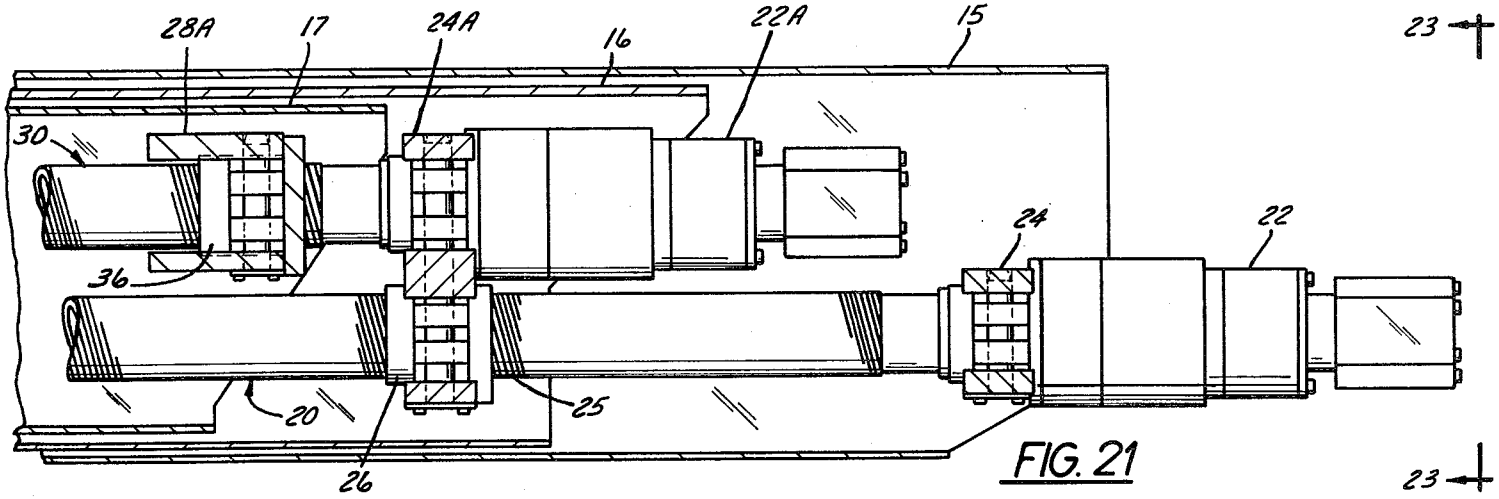
FIG. 21 is an enlarged side elevational view, partly in cross-section and with portions broken away, of some components shown in FIG. 19.
Figure 23:
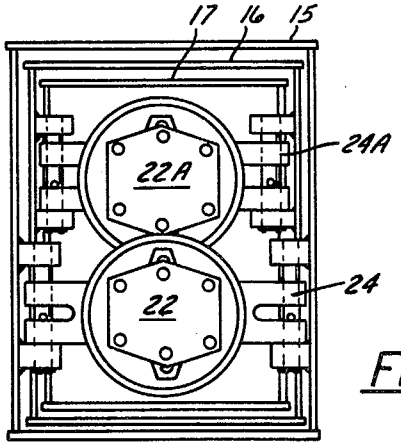
FIG. 23 is an enlarged, end view taken on line 23—23 of FIG. 21.
Figure 22:
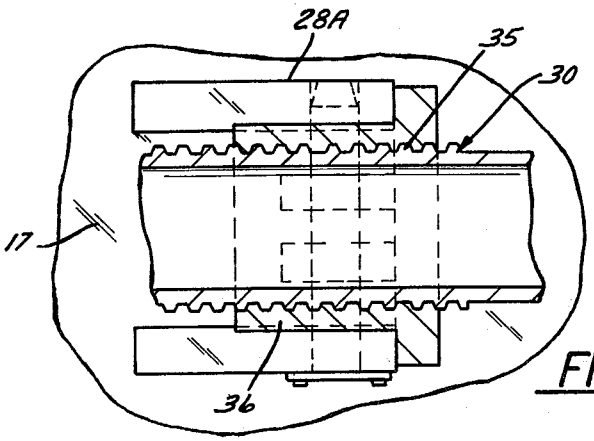
FIG. 22 is an enlarged, cross-sectional view of the screw drive means shown in FIG. 21.

Referring to FIGS. 19 and 20, which respectively show boom 10 fully retracted and extended, and to FIGS. 21, 22 and 23, in the third embodiment, the screws 20 and 30 are independently driven and supported at their base ends by motors 22 and 22A, respectively, which are mounted on the base ends of the boom sections 15 and 16, respectively, by support brackets 24 and 24A, respectively. The screws 20 and 30 engage the nuts 26 and 36, respectively, at the base ends of the booms sections 16 and 17, respectively, and rotate to effect boom sections movement as hereinbefore described.

I claim:

1. In a multisection telescopic boom: a hollow base section; a hollow intermediate section telescopable within said base section; a hollow fly section telescopable within said intermediate section; a first elongated rotatable screw located within said boom and having its base end rotatably mounted on and connected to the base end of said base section; a first nut means rigidly mounted on the base end of said intermediate section and engaged by said first screw; a second elongated rotatable screw located within said boom and having its base end rotatably mounted on and connected to the base end of said intermediate section; a second nut means rigidly mounted on the base end of said fly section; and screw drive means operable to rotate both screws simultaneously to effect simultaneous axial telescopic movement of the axially movable boom sections, said screw drive means comprising at least one motor connected to effect rotation of said first screw, and means connected to said second screw to effect rotation of said second screw.

2. A boom according to claim 1 wherein said means to effect rotation of said second screw is a second motor.

3. A boom according to claim 1 wherein said means to effect rotation of said second screw comprises rotation transmission means connected between said first screw and said second screw whereby rotation of the former effects rotation of the latter.

4. A boom according to claim 3 wherein said rotation transmission means includes a first coupling member rotatably driven by said first screw, a second coupling member for rotatably driving said second screw, and means to enable said first coupling member to drive said second coupling member.

5. A boom according to claim 4 wherein said last recited means comprises an endless flexible drive chain.

6. A boom according to claim 3 wherein said rotation transmission means includes interengageable means on said first and second screws.

7. A boom according to claim 6 wherein said second screw is hollow and said first screw extends thereinto, and wherein said interengageable means includes a projection on said first screw engageable with an axially extending groove on the hollow interior of said second screw.

8. A boom according to claims 1 or 2 or 3 further including support means connected to said screws to support said screws on said boom.

9. A boom according to claim 8 wherein said support means is axially movable relative to at least some of said boom sections.

* * * * *